United States Patent [19]

Zellweger et al.

[11] 4,102,633

[45] Jul. 25, 1978

[54] CIGARETTE LIGHTER

[75] Inventors: Conrad Zellweger, Chêne-Bougeries; André Guenin, Petit-Lancy, both of Switzerland

[73] Assignee: La Nationale S.A., Geneva, Switzerland

[21] Appl. No.: 724,228

[22] Filed: Sep. 17, 1976

[30] Foreign Application Priority Data

Sep. 26, 1975 [CH] Switzerland ..... 12537/75

[51] Int. Cl.[2] ..... F23Q 25/00

[52] U.S. Cl. ..... 431/152; 431/277

[58] Field of Search ..... 431/142–143, 431/150–152, 254, 276, 277

[56] References Cited

U.S. PATENT DOCUMENTS

| | | | |
|---|---|---|---|
| 3,055,201 | 9/1962 | Smith | 431/150 |
| 3,213,647 | 10/1965 | Sakamoto | 431/142 |
| 3,301,020 | 1/1967 | Kruizenga | 431/151 |
| 3,765,822 | 10/1973 | Chevallier | 431/150 |
| 3,910,750 | 10/1975 | Guenin | 431/150 |

*Primary Examiner*—Carroll B. Dority, Jr.

*Attorney, Agent, or Firm*—Emory L. Groff, Jr.

[57] ABSTRACT

A cigarette lighter comprising a body forming a fuel container, a burner, ignition means, and a cap hinged to the body. The body and the cap have the same cross-section. One of the two parts formed by the body and the cap carries a collar into which the other part is engaged in the closed position of the cigarette lighter. The hinge between the body and the cap is inclosed within the space comprised between said two parts.

3 Claims, 5 Drawing Figures

FIG. 1
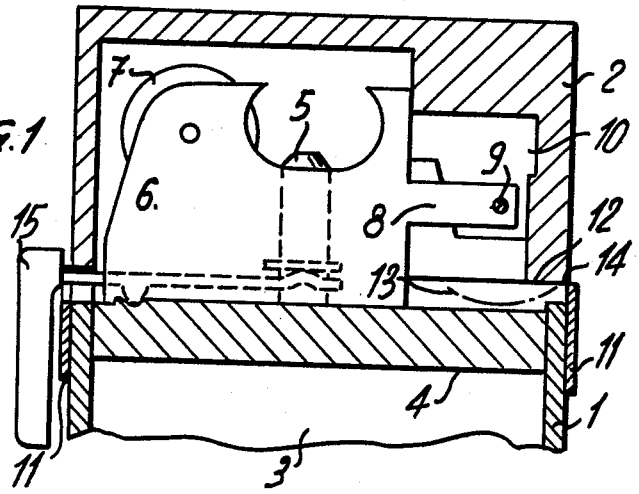
FIG. 2
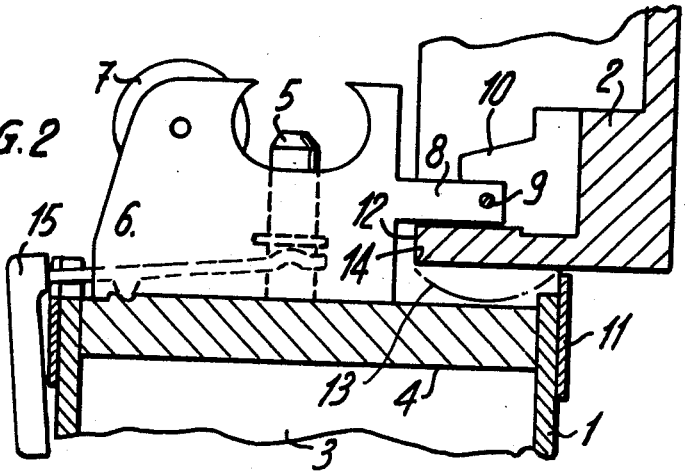
FIG. 5
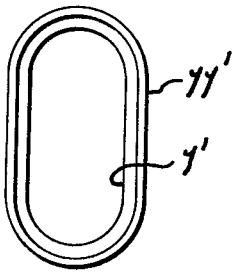
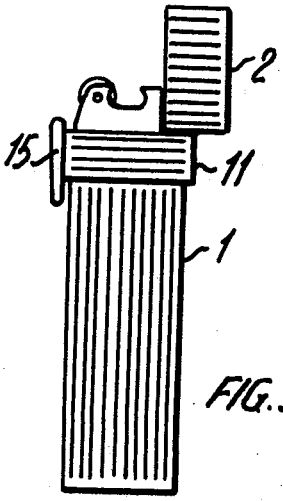
FIG. 3
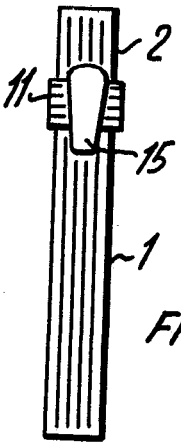
FIG. 4

CIGARETTE LIGHTER

This invention relates to a cigarette lighter of the type comprising a body and a cap hinged to the body to enable the body to be closed when the lighter is not being used.

The invention is particularly concerned with an arrangement of the cap and body of the lighter, which arrangement enables new decorative effects to be obtained.

In accordance with the invention there is provided a cigarette lighter comprising a body forming a fuel container, a fuel burner, an ignition means for igniting fuel issuing from the burner, and a cap hinged to the body and which, in a closed position, covers the burner and the ignition means when the lighter is not being used, and wherein the body and the cap have the same cross-section and are arranged to enable one to engage in the other in the closed position of the cap, said other of these two parts carrying a collar situated around the edge separating the body and the cap, the inner cross-section of the collar corresponding to the cross-section of the part to be engaged in said collar, the hinge between the body and cap being enclosed within the space defined by said one of these two parts.

In order that the invention may be better understood an embodiment thereof will now be described by way of example only and with reference to the accompanying drawings in which:

FIGS. 1 and 2 are cross sections through part of one embodiment of a cigarette lighter according to this invention, showing the cap of the lighter in the closed and open positions respectively; and FIGS. 3 and 4 are respectively a side view and front view on a reduced scale of the lighter of FIGS. 1 and 2.

FIG. 5 is a top plan view of the body and collar of a lighter having an alternative cross-sectional configuration.

Referring to the drawings, the cigarette lighter is of elongate form and comprises a body 1 and cap 2 which are hingedly connected one with the other so that the cap is able to take up a closed position (shown in FIG. 1) and an open position (shown in FIG. 2) with respect to the body. The body 1 and cap 2 have the same cross-section in the plane at right-angles to the direction in which the largest dimension of the body 1 extends. The lower edge 12 of the cap 2 which abuts the body 1 in the closed position in planar.

The body 1 defines a container 3 which is closed at the top by a partition 4 in which is formed a hole (not shown) affording passage to a burner 5. The burner is designed to receive fuel in the form of liquiefied gas stored in the container 3. The burner 5 is combined in the customary manner with a valve (not shown) which enables a passage for supplying the fuel gas to the burner to be opened and closed selectively.

The burner is positioned between two parallel plates 6, only one of which can be seen in the drawings. These plates serve to support a knurled wheel 7 which actuates an ignition means comprising a friction wheel and flint. The plates 6 each have a tab 8 through which passes a pivot shaft 9 about which the cap 2 is hinged. For this purpose the cap 2 is rigidly connected to a part 10 which is mounted on the shaft 9 between the two tabs 8.

The upper edge of the outer wall of the body 1 is formed by a decorative collar 11 which forms a surround along the edge separating the body 1 of the lighter from the cap 2. All of the parts involved are so arranged that when the cap 2 is in the closed position the lower edge 12 of the cap is partly engaged with the decorative collar 11, and this results in a very pleasant appearance of the lighter, since the edge of the cap is not visible when the cap is closed. Furthermore no part of the hinge is visible since the hinge between the cap body 1 and cap 2 is enclosed within the cap 2.

In FIG. 1, the line 13 indicates the path of movement of the corner 14 of the cap when the latter moves between the open and closed positions. It will be seen that this path of movement is such that the cap 2 is able to pivot freely without being impeded when it is partially engaged within the decorative collar 11. It will also be seen that, in the closed position of the cap 2, there exists a small clearance between the abutting edges.

The decorative collar 11 engages one end 15 of a lever actuating the valve of the lighter, this end 15 likewise forming a decorative part.

A number of different constructions are also possible. For example, the decorative collar 11 could be carried by the cap 2 and not by the body 1. In this case the pivot shaft about which the cap 2 is hinged on the body should be positioned within the interior of the body 1.

The construction described above is particularly advantageous when the horizontal cross-section of the lighter is not rectangular such as illustrated in FIG. 5. even in this case, the construction readily enables a collar 11' to cooperate with a cap so that when closed, the body 1' of the lighter forms a juncture with the cap in a very precise manner, whereas in the known arrangements, a precise line of contact between the body of the lighter and the cap can be difficult to achieve.

We claim:

1. A cigarette lighter including, a body having an interior including a fuel container, partition means closing the top of said container, a fuel burner, ignition means for igniting fuel issuing from said burner, a hollow cap having an interior and a lower side edge and disposed atop said body, said cap when in a closed position covering said burner and ignition means when the lighter is not being used, said cap and body having an identical cross-section and respectfully having exposed edges juxtaposed when said lighter is closed, hinge means disposed within one said interior and joining said cap to said partition said hinge means spacing at least that portion of the edge of said cap adjacent the hinge means from the respective edge of said body so that the cap can pivot open freely without hitting the respective edge of the body or the partition means, a collar mounted around the exterior of said body and surrounding the periphery of said exposed edge of said cap to cover the space between said cap and body, and said collar having an inner cross-section corresponding to the cross-section of said cap.

2. A lighter according to claim 1 wherein, that edge of said cap juxtaposed said body in the closed position of said cap is disposed in a planar surface and has a nonrectangular contour.

3. A lighter according to claim 1 wherein the exterior surface of said collar is decorative.

* * * * *